US011482064B2

(12) United States Patent
Oh et al.

(10) Patent No.: US 11,482,064 B2
(45) Date of Patent: Oct. 25, 2022

(54) POWER CONTROL SYSTEM FOR AN ELECTRIC VEHICLE AND A METHOD THEREFOR

(71) Applicants: HYUNDAI MOTOR COMPANY, Seoul (KR); KIA CORPORATION, Seoul (KR)

(72) Inventors: Da Ye Oh, Seoul (KR); Ki Suk Lee, Hwaseong-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/395,218

(22) Filed: Aug. 5, 2021

(65) Prior Publication Data

US 2022/0198849 A1 Jun. 23, 2022

(30) Foreign Application Priority Data

Dec. 21, 2020 (KR) ..... 10-2020-0180236

(51) Int. Cl.
*G07C 9/00* (2020.01)

(52) U.S. Cl.
CPC ..... *G07C 9/00309* (2013.01); *G07C 2009/00603* (2013.01)

(58) Field of Classification Search
None
See application file for complete search history.

(56) References Cited

U.S. PATENT DOCUMENTS

2008/0094031 A1* 4/2008 Singh ..... H01M 10/42 320/132
2011/0210818 A1* 9/2011 Denison ..... G07F 17/0014 340/5.6
2014/0132224 A1* 5/2014 Pisharodi ..... H02J 7/0071 320/149

* cited by examiner

*Primary Examiner* — Carlos Garcia
(74) *Attorney, Agent, or Firm* — Lempia Summerfield Katz LLC

(57) ABSTRACT

A power control system for an electric vehicle without a start manipulator, and a method therefor, includes a communication device that performs wireless communication with an electronic key and a body controller connected with the communication device. The body controller determines a power control mode as a factory mode or an electronic key discharge mode based on whether an electronic key is learned and whether a battery of the electronic key is discharged and controls vehicle power transition depending on power transition logic matched to the determined power control mode.

20 Claims, 7 Drawing Sheets

POWER CONTROL SYSTEM FOR AN ELECTRIC VEHICLE AND A METHOD THEREFOR

CROSS-REFERENCE TO RELATED APPLICATION

This application claims the benefit of priority to Korean Patent Application No. 10-2020-0180236, filed in the Korean Intellectual Property Office on Dec. 21, 2020, the entire contents of which are incorporated herein by reference.

TECHNICAL FIELD

The present disclosure relates to a power control system for an electric vehicle and a method therefor.

BACKGROUND

With the development of information technology (IT), various electronic keys, such as fobs, smart keys, and digital keys, which are capable of opening and closing vehicle doors or starting the engine without using a mechanical key, have been proposed. An electronic key may embed unique identification information. When approaching a vehicle, the electronic key may transmit the embedded unique identification information to an electronic control unit in the vehicle using wireless communication. The electronic control unit in the vehicle may receive the unique identification information transmitted from the electronic key to perform user authentication. When user authentication is successfully performed, the electronic control unit may open and close a vehicle door or start the vehicle depending on user manipulation. When user authentication fails or it is impossible to perform user authentication when the vehicle to which the electronic key is applied is used, it is unable to open and close the vehicle door or start the vehicle. For example, when a digital key is shared from a vehicle owner to use a vehicle such as a sharing car or a robotaxi, when the vehicle is in a factory mode where a smart key is not learned or when a battery of the fob is discharged, the vehicle will be unable to perform authentication. Accordingly, because it is impossible to perform user authentication, the digital key is unable to control the vehicle.

SUMMARY

The present disclosure has been made to solve the above-mentioned problems occurring in the prior art while maintaining advantages achieved by the prior art.

An aspect of the present disclosure provides a power control system for an electric vehicle to facilitate vehicle power transition in a situation where it is difficult to perform user authentication using an electronic key in a vehicle where a start manipulator is not included. Another aspect of the present disclosure provides a method therefor.

The technical problems to be solved by the present disclosure are not limited to the aforementioned problems. Any other technical problems not mentioned herein should be clearly understood from the following description by those having ordinary skill in the art to which the present disclosure pertains.

According to an aspect of the present disclosure, a power control system for an electric vehicle may include a communication device that performs wireless communication with an electronic key and a body controller connected with the communication device. The body controller may determine a power control mode as a factory mode or an electronic key discharge mode based on whether an electronic key is learned and whether a battery of the electronic key is discharged. The body controller may control vehicle power transition depending on power transition logic matched to the determined power control mode.

The body controller may determine the power control mode as the factory mode, when the electronic key is learned. The body controller may determine the power control mode as the electronic key discharge mode when the electronic key is not detected outside the vehicle and when a door is opened by a mechanical key, when the electronic key is learned.

The body controller may output an emergency start guide pop-up when the electronic key discharge mode is determined.

The body controller may verify a vehicle door state using a door switch in the electronic key discharge mode to determine whether a driver rides in the vehicle.

The body controller may transition a vehicle power state to a vehicle power on state, when it is possible for the electronic key to perform immobilizer communication and when there is a P-stage switch input. The body controller may transition the vehicle power state to an electric vehicle (EV) ready state, when there is a brake input in the vehicle power on state.

The body controller may transition the vehicle power state to a vehicle power off state, when there is the P-stage switch input in the vehicle power on state. The body controller may transition the vehicle power state to the vehicle power off state, when there are the brake input and the P-stage switch input in the EV ready state.

The body controller may perform external authentication or internal authentication of the electronic key in a vehicle power off state and may transition a vehicle power state to a vehicle power on state, when a driver rides in the vehicle or when a P-stage switch input is detected.

The body controller may perform the internal authentication of the electronic key in the vehicle power on state and may transition the vehicle power state to an EV ready state, when a brake input or the P-stage switch input is detected.

The body controller may switch a power control mode to a shared mode, when a door is unlocked using a shared electronic key. The body controller may transition to a vehicle power on state, when at least one door is opened and all doors are closed in a vehicle power off state. The body controller may transition to an EV ready state, when receiving a driving start request in the vehicle power on state. The body controller may transition to the vehicle power on state, when the vehicle arrives at a destination, at least one door is opened, and all the doors are closed. The body controller may transition to the vehicle power off state, when a vehicle door is locked using the shared electronic key in the vehicle power on state.

The body controller may switch to a Bluetooth call mode when internal authentication of the electronic key is not performed, when a vehicle speed is less than or equal to a reference speed in the EV ready state.

According to another aspect of the present disclosure, a power control method for an electric vehicle may include determining a power control mode as a factory mode or an electronic key discharge mode based on whether an electronic key is learned and whether a battery of the electronic key is discharged. The power control method may further include controlling vehicle power transition depending on power transition logic matched to the determined power control mode.

The determining of the power control mode may include determining the power control mode as the factory mode, when the electronic key is learned. The determining the power control mode may further include determining the power control mode as the electronic key discharge mode when the electronic key is not detected outside the vehicle and when a door is opened by a mechanical key, when the electronic key is learned.

The determining of the power control mode as the factory mode or the electronic key discharge mode may further include outputting an emergency start guide pop-up when the electronic key discharge mode is determined.

The controlling of the vehicle power transition may include verifying a vehicle door state using a door switch in the electronic key discharge mode to determine whether a driver rides in the vehicle.

The controlling of the vehicle power transition may include transitioning a vehicle power state to a vehicle power on state, when it is possible for the electronic key to perform immobilizer communication and when there is a P-stage switch input. The controlling of the vehicle power transition may also include transitioning the vehicle power state to an EV ready state when there is a brake input in the vehicle power on state.

The controlling of the vehicle power transition may further include transitioning the vehicle power state to a vehicle power off state when there is the P-stage switch input in the vehicle power on state. The controlling of the vehicle power transition may also include transitioning the vehicle power state to the vehicle power off state when there are the brake input and the P-stage switch input in the EV ready state.

The power control method may further include performing external authentication or internal authentication of the electronic key in a vehicle power off state and transitioning a vehicle power state to a vehicle power on state when a driver rides in the vehicle or when a P-stage switch input is detected.

The power control method may further include performing the internal authentication of the electronic key in the vehicle power on state and transitioning the vehicle power state to an EV ready state when a brake input or the P-stage switch input is detected.

The power control method may further include switching a power control mode to a shared mode, when a door is unlocked using a shared electronic key. The power control method may further include transitioning to a vehicle power on state when at least one door is opened and all doors are closed in a vehicle power off state. The power control method may further include transitioning to an EV ready state when receiving a driving start request in the vehicle power on state. The power control method may further include transitioning to the vehicle power on state when the vehicle arrives at a destination, at least one door is opened, and all the doors are closed. The power control method may further include transitioning to a vehicle power off state when a vehicle door is locked using the shared electronic key in the vehicle power on state.

The power control method may further include switching to a Bluetooth call mode when internal authentication of the electronic key is not performed, when a vehicle speed is less than or equal to a reference speed in the EV ready state.

BRIEF DESCRIPTION OF THE DRAWINGS

The above and other objects, features, and advantages of the present disclosure should be more apparent from the following detailed description taken in conjunction with the accompanying drawings.

DETAILED DESCRIPTION

Figure 1:
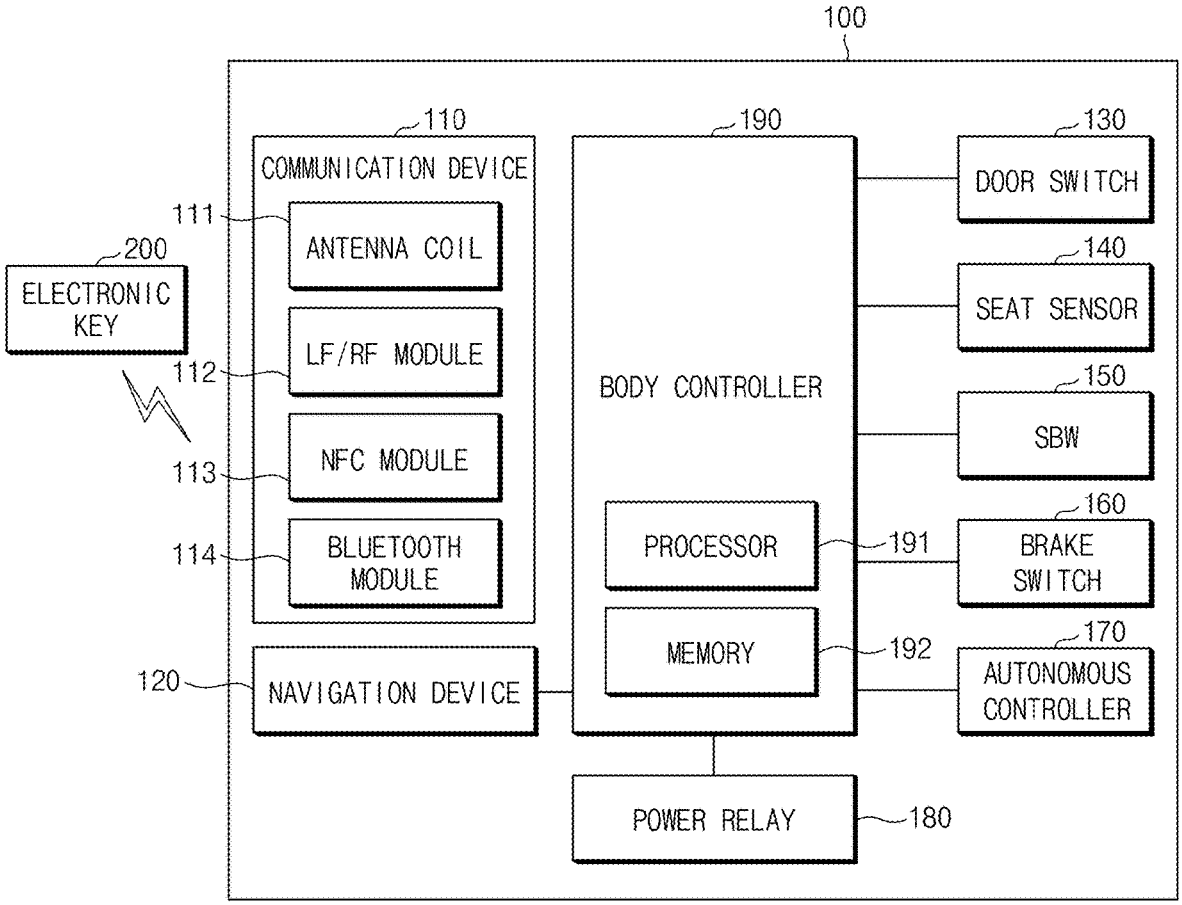
FIG. 1 is a block diagram illustrating a configuration of a power control system for an electric vehicle according to embodiments of the present disclosure.

Hereinafter, some embodiments of the present disclosure are described in detail with reference to the drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions has been omitted in order not to unnecessarily obscure the gist of the present disclosure. Also, when a component, device, element, or the like of the present disclosure is described as having a purpose or performing an operation, function, or the like, the component, device, or element should be considered herein as being "configured to" meet that purpose or to perform that operation or function.

In describing the components of the embodiment according to the present disclosure, terms such as first, second, "A", "B", (a), (b), and the like may be used. These terms are merely intended to distinguish one component from another component, and the terms do not limit the nature, sequence or order of the constituent components. Unless otherwise defined, all terms used herein, including technical or scientific terms, have the same meanings as those generally understood by those having ordinary skill in the art to which the present disclosure pertains. Such terms as those defined in a generally used dictionary are to be interpreted as having meanings consistent with the contextual meanings in the relevant field of art. Such terms are not to be interpreted as having ideal or excessively formal meanings unless clearly defined as having such in the present application.

Embodiments of the present disclosure relate to technologies to facilitate vehicle power transition in a situation where it is difficult to perform user authentication using an electronic key (e.g., a remote key, a fob, a smart key, a digital key, and/or the like) in an electric vehicle in which a start manipulator (e.g., a start key) is deleted. The situation where it is difficult to perform the user authentication using the electronic key may be when the vehicle system is in a factory mode (in a state where the electronic key is not learned), when the battery of the electronic key is discharged (i.e., not charged), when the shared digital key is used, or the like.

FIG. 1 is a block diagram illustrating a configuration of a power control system for an electric vehicle according to embodiments of the present disclosure.

Referring to FIG. 1, a power control system 100 may include a communication device 110, a navigation device 120, a door switch 130, a seat sensor 140, a shift by wire (SBW) 150, a brake switch 160, an autonomous controller 170, a power relay 180, a body controller 190, and the like.

The communication device 110 may facilitate communication or communicate with an electronic device located inside or outside a vehicle. The communication device 110 may include an antenna coil 111, a low frequency/radio frequency (LF/RF) module 112, a near field communication (NFC) module 113, a Bluetooth module 114, and the like.

The antenna coil 111 may support communication between an immobilizer and a transponder of the electronic key 200. The antenna coil 111 may be separately installed near a console in the vehicle, and in which a start manipulator is not included. The antenna coil 111 may be used such that a vehicle system (e.g., a smart key system) learns the electronic key 200 in the factory mode. For example, after the electronic key 200 is put within a communication possible distance (i.e., within communication range) capable of being covered by the antenna coil 111, the antenna coil 111 may make the vehicle system learn the electronic key 200.

The LF/RF module 112 may determine whether the electronic key 200 is located in the vehicle using LF communication and RF communication. In other words, the LF/RF module 112 may be used for internal authentication of the electronic key 200. The LF/RF module 112 may include an LF antenna and/or an RF receiver. The LF/RF module 112 may transmit a response request signal for internal authentication of the electronic key 200 via the LF antenna. The LF/RF module 112 may receive a response signal transmitted from the electronic key 200 using RF communication.

The NFC module 113 may facilitate external authentication and/or internal authentication of the electronic key 200 through NFC communication with the electronic key 200. The NFC module 113 may be installed in an exterior door handle, a wireless power control unit (WPC), and/or the like. It may be detected whether the electronic key 200 is located outside the vehicle using the NFC module 113 mounted on the exterior door handle upon external authentication of the electronic key 200. It may be detected whether the electronic key 200 is located inside the vehicle using the NFC module 113 mounted on the WPC upon internal authentication of the electronic key 200.

The Bluetooth module 114 may support wireless communication with a user terminal. For example, the Bluetooth module 114 may support a Bluetooth call. The user terminal may be an electronic device capable of performing wireless and/or wired communication, which may be a smartphone, a tablet, a personal digital assistant (PDA), a portable multimedia player (PMP), a laptop computer, and/or the like.

When a destination is set, the navigation device 120 may search for a driving route to the destination and may guide a driver along the driving route. The navigation device 120 may search for an optimal route (e.g., the shortest distance, a minimum time, and/or the like) by reflecting real-time traffic information when searching for a driving route. Although not illustrated in the drawing, the navigation device 120 may include a memory for storing map data, a global positioning system (GPS) receiver for measuring a vehicle location, a communication module for receiving traffic information from the outside, a display (e.g., a touch screen) for overlapping and displaying a vehicle location and a driving route on the map data, a processor for searching for a driving route and guiding a driver along the found driving route, and/or the like.

The door switch 130 may be installed in each of vehicle doors to transmit a signal indicating a door state to the body controller 190. For example, the door switch 130 may transmit a signal indicating that the door is opened, whether the door is closed, whether the door is locked, whether the door is unlocked, and/or the like.

The seat sensor 140 may be mounted on a seat (e.g., the driver's seat) in the vehicle to sense whether a user sits in the seat. A weight sensor, a pressure sensor, and/or the like may be applied to or as the seat sensor 140.

The SBW 150 may adjust a gear stage of a transmission depending on manipulation of the user. The gear stage may be divided into a park (P) stage, a drive (D) stage, a reverse (R) stage, a neutral (N) stage, and the like. The SBW 150 may transmit a signal indicating whether a P-stage switch, a D-stage switch, an R-stage switch, an N-stage switch, or the like is input to the body controller 190. The SBW 150 may be applied in the form of a button, a dial, a lever, or the like.

The brake switch 160 may detect a brake state according to manipulation of the brake. The brake switch 160 may transmit a signal indicating a brake state, that is, whether the brake is input to the body controller 190. For example, the brake switch 160 may output '1', when the user puts on or activates the brake, and may output '0', when the user does not put on or activate the brake.

The autonomous controller 170 may recognize a vehicle state and a driving environment using various sensors (e.g., a camera, a radar, a light detection and ranging (LiDAR), an ultrasonic sensor, and/or the like) provided in the vehicle. The autonomous controller 170 may control a behavior (e.g., steering, acceleration, deceleration, braking, and/or the like) of the vehicle with regard to the recognized vehicle state and the recognized driving environment to perform autonomous driving. The autonomous controller 170 may interwork with the navigation device 120 to plan a driving route and may drive the vehicle along the driving route. When the vehicle arrives at the destination, the autonomous controller 170 may notify the body controller 190 that the vehicle arrives at the destination. Although not illustrated in the drawing, the autonomous controller 170 may include a processor and may include a memory installed inside and/or outside the autonomous controller 170.

The power relay 180 may set a transfer path of power, which may be implemented as a switching element. In other words, the power relay 180 may perform vehicle power transition under an instruction of the body controller 190. The power relay 180 may transition a vehicle power state. The vehicle power state may be divided into a vehicle power off state, a vehicle power on state, an electric vehicle (EV) ready state, and the like. The vehicle power on state may be a state where power is supplied to all of the electric devices in the vehicle and the EV ready state may be a state where power can be supplied to a drive motor loaded into the vehicle.

The body controller 190 may be an integrated body control unit (IBU) in which electric control units such as a body control module (BCM), a smart key system, a parking assist system, a tire pressure monitoring system, and/or an immobilizer are integrated into one. The body controller 190 may include a processor 191 and a memory 192. The processor 191 may perform the overall control of the body controller 190. The processor 191 may include at least one or more processing devices, such as an application specific integrated circuit (ASIC), a digital signal processor (DSP), programmable logic devices (PLD), field programmable gate arrays (FPGAs), a central processing unit (CPU), microcontrollers, and/or microprocessors. The memory 192 may be a non-transitory storage medium, which stores instructions executed by the processor 191. The present embodiment includes the memory 192 located inside the body controller 190, but the present disclosure is not limited thereto. For example, the memory 192 may be located outside the body controller 190. The memory 192 may include at least one storage media, such as a flash memory, a hard disk, a random access memory (SSD), a static RAM (SRAM), a read only memory (ROM), a programmable ROM (PROM), an electrically erasable and programmable ROM (EEPROM), an erasable and programmable ROM (EPROM), and/or a register.

The body controller 190 may perform user authentication (electronic key authentication) and/or vehicle power transition control in the electric vehicle in which the start manipulator (e.g., the start button) is not included. When receiving a predetermined event signal, the body controller 190 may wake up.

When waking up, the body controller 190 may determine whether the electronic key 200 is learned in the vehicle system. The body controller 190 may determine a power control module depending on whether the vehicle system learns the electronic key 200. When the vehicle system does not learn the electronic key 200, the body controller 190 may determine the power control module as a factory mode.

The body controller 190 may determine whether it is possible for the electronic key 200 to perform immobilizer communication (hereinafter referred to as "IMMO communication") in the factory mode. In other words, the body controller 190 may determine whether it is possible to perform communication between the electronic key 200 and the antenna coil 111. When the P-stage switch input is held above a predetermined time (e.g., 2 seconds) in the state where it is possible to perform the IMMO communication, the body controller 190 may supply a vehicle power for vehicle diagnosis. In other words, the body controller 190 may switch (transition) the vehicle power state from a vehicle power off state to a vehicle power on state.

Furthermore, the body controller 190 may operate the vehicle power state in the vehicle power on state or an EV ready state for vehicle inspection in the factory mode. The body controller 190 may determine transition from the vehicle power on state or the EV ready state to the vehicle power off state based on a P-stage switch input, a brake input, and/or the like. For example, when the P-stage switch input is held above 2 seconds in the EV ready state, the body controller 190 may switch to the vehicle power off state. When the brake input and the P-stage switch input above 2 seconds are detected in the vehicle power on state, the body controller 190 may switch to the vehicle power off state.

When the vehicle system learns the electronic key 200, the body controller 190 may determine whether the battery of the electronic key 200 is discharged. When the electronic key 200 is not detected outside the vehicle and when the door of the vehicle is unlocked by a mechanical key, the body controller 190 may determine that the battery of the electronic key 200 is discharged to determine the power control mode as an electronic key discharge mode. Because it is impossible to perform internal authentication of the electronic key 200 using LF communication and RF communication when the battery of the electronic key 200 is discharged, the electronic key discharge mode is determined. The body controller 190 may output a pop-up (an emergency start guide pop-up) providing a notification of an emergency start method (an internal authentication method) using IMMO communication on a cluster when the electronic key discharge mode is determined. Thereafter, the body controller 190 may determine whether the driver rides in the vehicle using the seat sensor 140 and the door switch 130.

When the driver rides in the vehicle, the body controller 190 may determine to transition the vehicle power state based on information such as a state where it is possible for the electronic key 200 to perform IMMO communication, a P-stage switch input, and/or a brake input. When the electronic key 200 is within a communication possible distance (i.e., within communication range) of the antenna coil 111 near a console in the vehicle, the body controller 190 may determine that it is possible for the electronic key 200 to perform IMMO communication. When it is possible for the electronic key 200 to perform the IMMO communication in the vehicle power off state and when the P-stage switch input is held above 2 seconds, the body controller 190 may control the power relay 180 to transition to the vehicle power on state. When it is possible for the electronic key 200 to perform the IMMO communication in the vehicle power off state or the vehicle power on state, when the P-stage switch input is held above 2 seconds, and when there is a brake input, the body controller 190 may transition to an EV ready state.

When the P-stage switch input above 2 seconds by the SBW 150 is detected in the EV ready state, the body controller 190 may transition to the vehicle power off state. When detecting a brake input using the brake switch 160 in the vehicle power on state and detecting a P-stage switch input above 2 seconds by means of the SBW 150, the body controller 190 may transition to the vehicle power off state.

The body controller 190 may execute internal authentication for only the electronic key 200 authorized by a vehicle owner using NFC communication. The vehicle owner may give the user the authority to use the electronic key 200. At this time, the vehicle owner may restrict an available time, an available function, and/or the like of the electronic key 200. For example, the vehicle owner may give the user the authority to use the electronic key 200 by a time requested by the user. Furthermore, the vehicle owner may give the user the authority to use a function such as door lock, door unlock, a trunk and tailgate, power control, and/or the like.

When the driver's door is opened and it is successful to perform internal authentication of the electronic key 200, when at least one of vehicle doors is opened and all doors are then closed and it is successful to perform internal authentication of the electronic key 200, or when the P-stage switch is input and it is successful to perform internal authentication of the electronic key 200, the body controller 190 may transition from the vehicle power off state to the vehicle power on state. When there is a brake input in the vehicle power on state and when it is successful to perform internal authentication of the electronic key 200, the body controller 190 may transition to the EV ready state. When at least one door is opened in a state where the driver does not ride in the vehicle, the vehicle speed is less than a threshold speed, and the gear stage is the P-stage, or when at least one door is opened, all the doors are closed, the electronic key 200 is not present inside the vehicle, and the gear stage is the P stage, the body controller 190 may transition from the EV ready state to the vehicle power on state. When the door switches to a lock state in the vehicle power on state and the gear stage is the P stage, or when the P-stage switch is input during a predetermined time, the body controller 190 may transition from the vehicle power on state to the vehicle power off state.

Furthermore, when the door is unlocked using the shared electronic key 200, the body controller 190 may change power transition logic. When at least one of vehicle doors is opened in the vehicle power off state and all the doors are then closed, the body controller 190 may transition to the vehicle power on state. When a driving start request is received in the vehicle power on state, the body controller 190 may transition from the vehicle power on state to the EV ready state. For example, the body controller 190 may display a driving start button on a display of the navigation device 120 and may transition the vehicle power state to the EV ready state, when the driving start button is input by the user.

After the vehicle arrives at a destination, when at least one of the vehicle doors is opened and all the doors are then closed, the body controller 190 may transition from the EV ready state to the vehicle power on state. When the user locks the door using the authorized electronic key or tags the authorized electronic key to an outdoor handle to lock the door, the body controller 190 may transition from the vehicle power on state to the vehicle power off state.

The body controller 190 may perform external authentication or internal authentication of the electronic key 200 and may identify an intention of the user to ride in the vehicle based on the seat sensor 140 and information about a P-stage switch input of the SBW 150. After the user unlocks the driver's door by means of NFC communication between the electronic key 200 and the NFC module 113, when detecting that the user sits in the driver's seat or when the P-stage switch input is detected, the body controller 190 may switch from the vehicle power off state to the vehicle power on state.

For example, in a state where it is successful to perform external authentication of the electronic key 200 using NFC communication outside the vehicle, when the user rides in the driver's seat or when the P-stage switch is input, the body controller 190 may switch the vehicle power state from the vehicle power off state to the vehicle power on state. At this time, the external authentication of the electronic key 200 may be held during a predetermined time, for example, 30 seconds. When the authentication of the electronic key 200 expires because the predetermined time elapses, the body controller 190 may output a guide pop-up "Put your phone on the wireless charger" on the cluster, when detecting that the driver rides in the vehicle or when the P-stage switch is input. The body controller 190 may perform internal authentication of the electronic key 200 by means of NFC communication with the WPC in the vehicle power off state and may transition to the vehicle power on state, when detecting that the driver rides in the vehicle or when the P-stage switch is input. The body controller 190 may perform internal authentication of the electronic key 200 in the vehicle power on state and may transition to the EV ready state, when the brake input or the P-stage switch input is held above 10 seconds. When the vehicle speed is moving less than or equal to a reference speed (e.g., 5 kph) in the EV ready state and when the internal authentication of the electronic key 200 is not performed, the body controller 190 may output a pop-up querying about switching to a Bluetooth call mode on the cluster.

The body controller 190 may perform internal authentication of the electronic key 200 in the vehicle power off state and may transition to the EV ready state, when the P-stage switch input is held above 10 seconds. When the internal authentication of the electronic key 200 is not performed in the EV ready state and when at least one door is opened, all the doors are then closed, and the P-stage switch is input, the body controller 190 may transition to the vehicle power on state. When the user tags the electronic key 200 to the NFC module 113 of the exterior door handle in the vehicle power on state, the body controller 190 may transition to the vehicle power off state.

Figure 2:
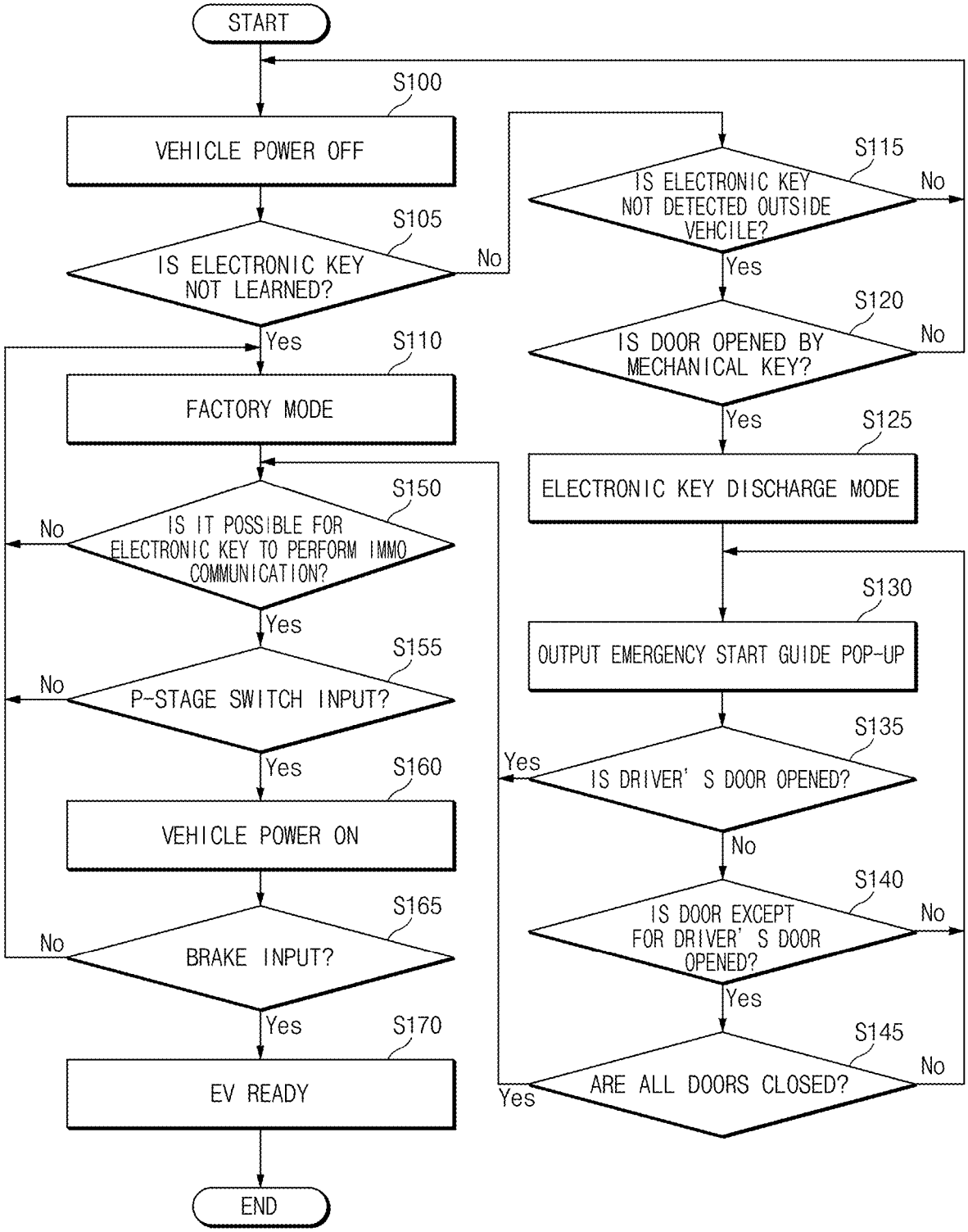
FIG. 2 is a flowchart illustrating a vehicle power control method according to an embodiment of the present disclosure.

FIG. 2 is a flowchart illustrating a vehicle power control method according to an embodiment of the present disclosure.

In S100, a body controller 190 of FIG. 1 may operate in a vehicle power off state. The body controller 190 may operate in a sleep mode in the vehicle power off state and may switch from the sleep mode to a wake-up mode when receiving a predetermined event signal.

In S105, the body controller 190 may determine whether a vehicle system learns an electronic key 200 in the vehicle power off state. When waking up, the body controller 190 may determine whether the vehicle system learns the electronic key 200.

When the vehicle system does not learn the electronic key 200, in S110, the body controller 190 may determine a power control mode as a factory mode. The body controller 190 may change default power control logic to power control logic matched to the factory mode.

When the vehicle system learns the electronic key 200 in S105, in S115, the body controller 190 may determine whether the electronic key 200 is detected outside the vehicle. The body controller 190 may determine whether the electronic key 200 is located outside the vehicle using a communication device 110 of FIG. 1. When the electronic key 200 is located outside the vehicle, the body controller 190 may maintain the vehicle power off state. When the electronic key 200 is not located outside the vehicle, the body controller 190 may perform S120. The body controller 190 may determine whether a user who approaches the vehicle has the electronic key 200.

When the electronic key 200 is not detected outside the vehicle, in S120, the body controller 190 may determine whether a door is opened by a mechanical key. The body controller 190 may determine whether the user enters (rides in) the vehicle using the mechanical key.

When the door is opened by the mechanical key, in S125, the body controller 190 may determine the power control mode as an electronic key discharge mode. Because it is able to open the vehicle door using only the mechanical key when the battery of the electronic key 200 is discharged, the body controller 190 may determine that the battery of the electronic key 200 is discharged, when the door is opened by the mechanical key.

When the electronic key discharge mode is determined, in S130, the body controller 190 may output an emergency start guide pop-up. The body controller 190 may output a welcome pop-up and may output the emergency start guide pop-up on a display device (e.g., a cluster or a navigation device 120 of FIG. 1).

While outputting the emergency start guide pop-up, in S135, the body controller 190 may determine whether the driver's door is opened. The body controller 190 may determine whether the driver's door is opened using a door switch 130 mounted on the driver's door.

When the driver's door is not opened, in S140, the body controller 190 may determine whether a door except for the driver's door is opened. The body controller 190 may determine whether the door except for the driver's door is opened using the door switch 130 mounted on the corresponding door that is not the driver's door.

When the door except for the driver's door is opened, in S145, the body controller 190 may determine whether all doors are closed. The body controller 190 may determine that all the doors are closed using the door switch 130 mounted on each of the vehicle doors.

When all the doors are closed, in S150, the body controller 190 may determine whether it is possible to perform IMMO communication with the electronic key 200. When it is determined that all the doors of the vehicle are closed, the body controller 190 may determine whether it is possible to perform communication between the electronic key 200 and an antenna coil 111 of FIG. 1.

When it is possible to perform the IMMO communication with the electronic key 200, in S155, the body controller 190 may determine whether there is a P-stage switch input. The body controller 190 may detect the P-stage switch input by means of an SBW 150 of FIG. 1. The body controller 190 may determine whether the P-stage switch input is held during a predetermined time, for example, 2 seconds.

When there is the P-stage switch input, in S160, the body controller 190 may transition to a vehicle power on state. When the P-stage switch input is held above 2 seconds, the body controller 190 may switch from the vehicle power off state to the vehicle power on state.

In S165, the body controller 190 may determine whether there is a brake input in the vehicle power on state. The body controller 190 may determine whether there is a brake input using a brake switch 160 of FIG. 1.

When there is the brake input, in S170, the body controller 190 may transition to an EV ready state. When there is the brake input in the vehicle power on state, the body controller 190 may determine that the user has an intention to drive to switch from the vehicle power on state to the EV ready state.

When the power control mode is determined as the factory mode in S110 or when it is determined that the driver's door is opened in S135, the body controller 190 may perform S150.

When it is determined that the door except for the driver's door is closed in S140 or when it is determined that at least one door of the vehicle is opened in S145, the body controller 190 may return to S130.

When it is impossible for the electronic key 200 to perform the IMMO communication in S150, when there is no P-stage switch input in S155, or when there is no brake input in S165, the body controller 190 may return to S110.

According to the embodiment described above, because it is unable to determine a door opening and closing condition in the factory mode, the body controller 190 may fail to consider whether the door is opened or closed when determining power transition. Furthermore, because it is unable to perform internal authentication of the electronic key 200 using LF communication and RF communication in the factory mode or the electronic key discharge mode, the body controller 190 may perform internal authentication of the electronic key 200 using IMMO communication which uses the antenna coil 111.

Figure 3:
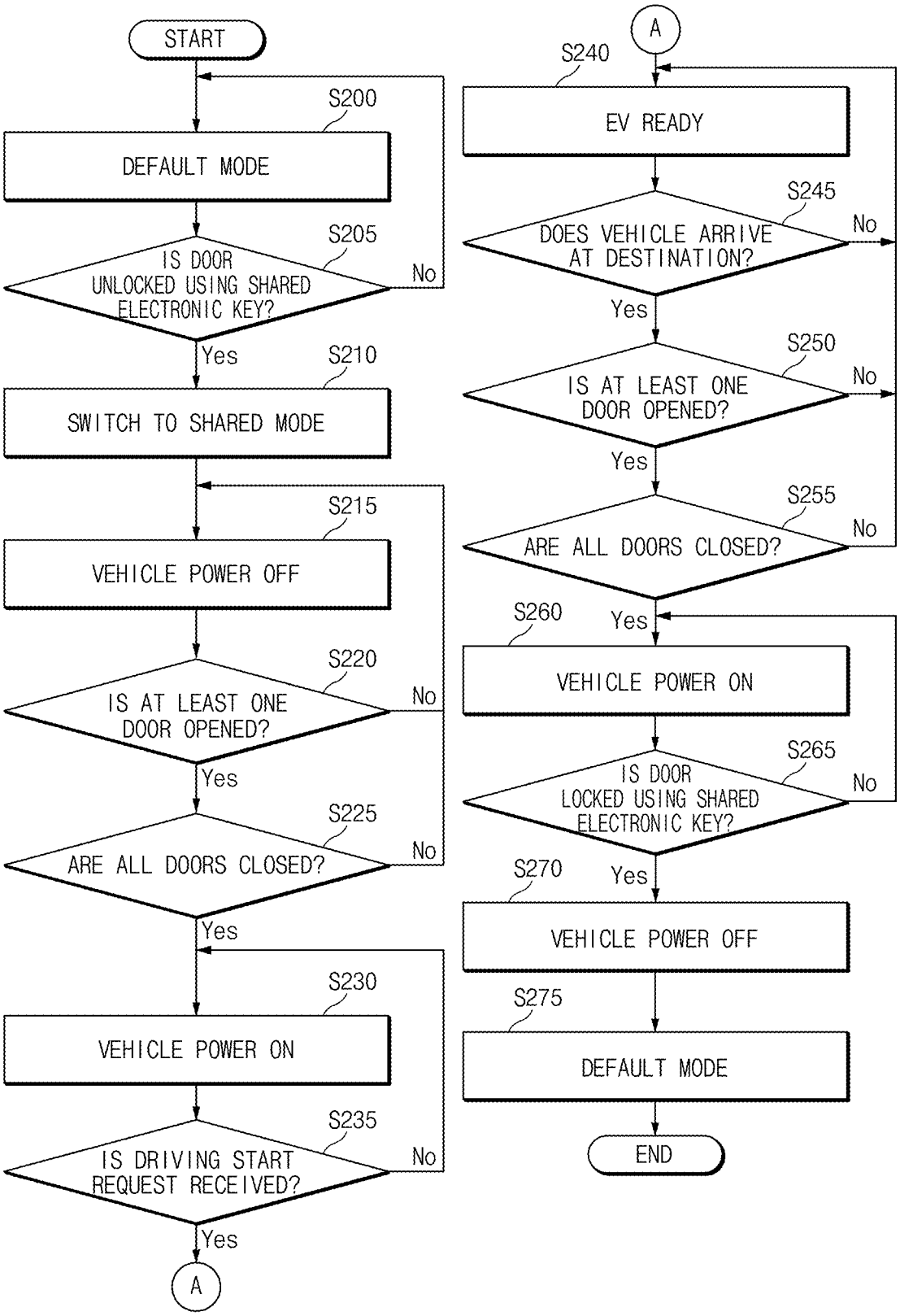
FIG. 3 is a flowchart illustrating a vehicle power control method according to another embodiment of the present disclosure.

FIG. 3 is a flowchart illustrating a vehicle power control method according to another embodiment of the present disclosure. The present embodiment uses a vehicle such as a sharing car or a robotaxi.

Referring to FIG. 3, in S200, a body controller 190 of FIG. 1 may operate in a default mode. The body controller 190 may perform internal authentication and/or external authentication of an electronic key 200 of FIG. 1 and may control to transition a vehicle power state based on whether a driver rides in a vehicle, a brake input, and/or the like.

In S205, the body controller 190 may determine whether the door is unlocked by a shared electronic key in the default mode. The shared electronic key may be a digital key authorized by a vehicle owner, which may be limited in an available time (e.g., a time requested by a user) and a function (e.g., door lock, door unlock, a trunk and tailgate, a power control function, and/or the like).

When the door is unlocked by the shared electronic key, in S210, the body controller 190 may switch a power control mode from the default mode to a shared mode. When the user unlocks the door using the shared electronic key or when the user tags the shared electronic key to an NFC module 113 mounted on an exterior door handle to unlock the door, the body controller 190 may change power transition logic. Because of unlocking the door using the authorized electronic key when entering the shared mode, the body controller 190 may fail to perform an internal authentication process of the shared electronic key after entering the shared mode.

After switching the power control mode to the shared mode, in S215, the body controller 190 may maintain the vehicle power state as a vehicle power off state.

In S220, the body controller 190 may determine whether at least one of the vehicle doors is opened in the vehicle power off state. The body controller 190 may detect that at least one of the vehicle doors is opened using a door switch 130 of FIG. 1.

After the at least one door is opened, in S225, the body controller 190 may determine whether all the doors are closed. When detecting that the at least one door is opened using the door switch 130, the body controller 190 may determine whether all the doors of the vehicle are closed.

When all the doors are closed, in S230, the body controller 190 may transition to a vehicle power on state. When the at least one door is opened and all the doors are closed in the vehicle power off state, the body controller 190 may switch from the vehicle power off state to the vehicle power on state using a power relay 180 of FIG. 1.

In S235, the body controller 190 may determine whether a driving start request is received in the vehicle power on state. The body controller 190 may output a driving start button on a display of a navigation device 120 of FIG. 1 in the vehicle power on state and may determine whether the driving start button is input by the user. Furthermore, the body controller 190 may receive a driving start request from an autonomous controller 170 of FIG. 1.

When the driving start request is received, in S240, the body controller 190 may transition from the vehicle power on state to an EV ready state. When there is the driving start request, the body controller 190 may switch from the vehicle power on state to the EV ready state.

In S245, the body controller 190 may determine whether the vehicle arrives at a destination in the EV ready state. The body controller 190 may receive destination arrival information from a navigation device 120 of FIG. 1 and/or the autonomous controller 170.

When the vehicle arrives at the destination, in S250, the body controller 190 may determine whether at least one door is opened. The body controller 190 may determine that at least one of vehicle doors is opened using the door switch 130.

After it is detected that the at least one of the vehicle doors is opened, in S255, the body controller 190 may determine whether all the doors are closed. The body controller 190 may determine that all the doors are closed using the door switch 130.

When all the vehicle doors are closed, in S260, the body controller 190 may transition the vehicle power state from the EV ready state to the vehicle power on state. When at least one of users who ride in the vehicle alights from the vehicle after the vehicle arrives at the destination, the body controller 190 may switch to the vehicle power on state.

In S265, the body controller 190 may determine whether the door is unlocked by the shared electronic key in the vehicle power on state.

When the door is locked using the shared electronic key, in S270, the body controller 190 may transition to the vehicle power off state. When the user locks the door using the shared electronic key, the body controller 190 may switch the vehicle power state to the vehicle power off state.

When transitioning to the vehicle power off state, in S275, the body controller 190 may switch the power control mode to the default mode.

Figure 4:
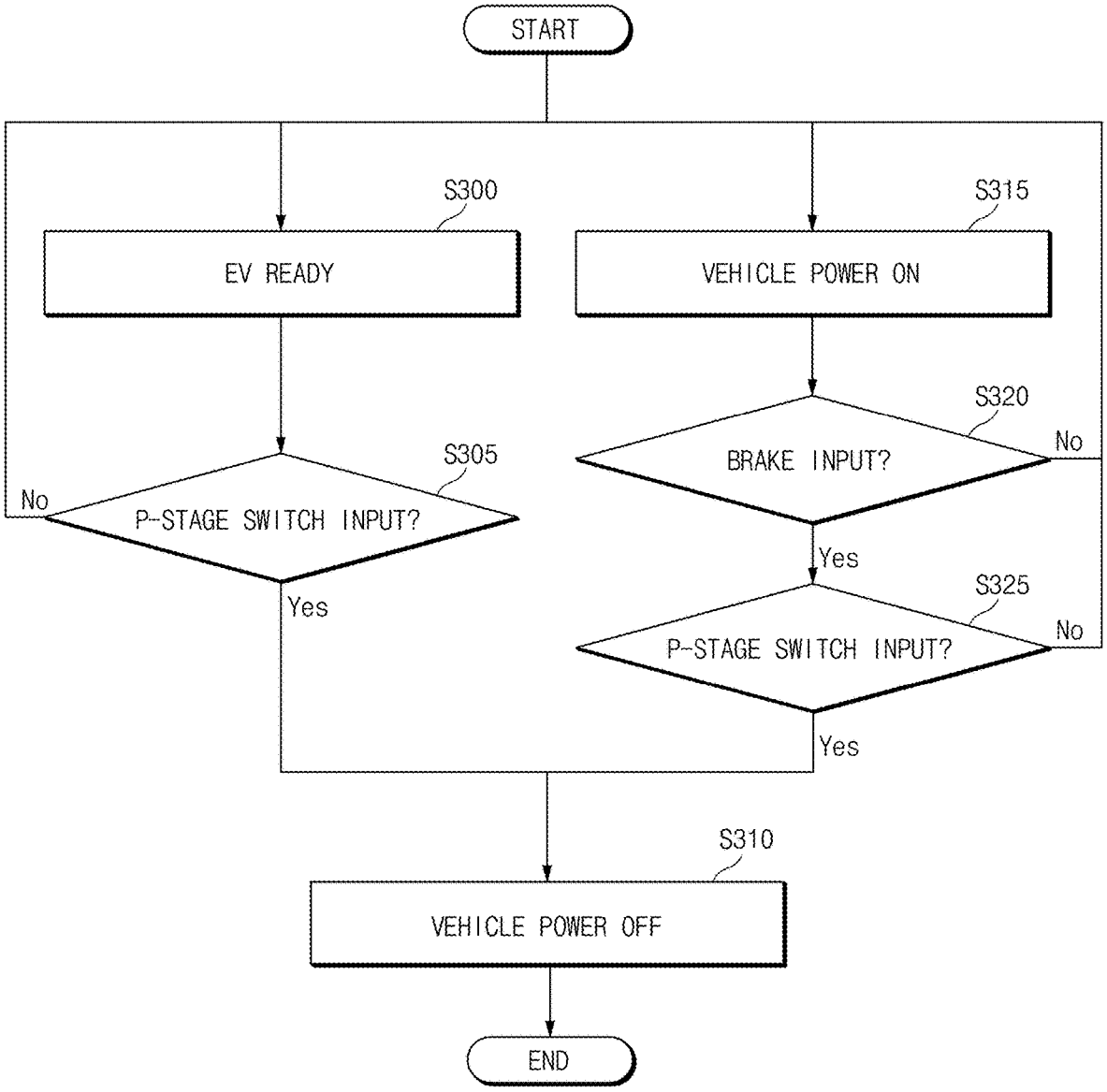
FIG. 4 is a flowchart illustrating a vehicle power control method according to another embodiment of the present disclosure.

FIG. 4 is a flowchart illustrating a vehicle power control method according to another embodiment of the present disclosure.

In S300, a body controller 190 of FIG. 1 may operate in an EV ready state.

In S305, the body controller 190 may determine whether there is a P-stage switch input in the EV ready state. The body controller 190 may determine whether a gear stage is held in a P stage for 2 seconds using an SBW 150 of FIG. 1.

When there is the P-stage switch input, in S310, the body controller 190 may transition to a vehicle power off state. When the gear stage is held in the P stage above 2 seconds, the body controller 190 may switch a vehicle power state to the vehicle power off state.

In S315, the body controller 190 may operate in a vehicle power on state.

In S320, the body controller 190 may determine whether there is a brake input in the vehicle power on state. The body controller 190 may determine whether there is a brake input using a brake switch 160 of FIG. 1.

When there is the brake input, in S325, the body controller 190 may determine whether there is a P-stage switch input. The body controller 190 may determine whether there is a P-stage switch input using the SBW 150.

When there is the P-stage switch input in S325, in S310, the body controller 190 may transition to the vehicle power off state. When the P-stage switch input is held above 2 seconds, the body controller 190 may switch the vehicle power state from the vehicle power on state to the vehicle power off state.

Figure 5:
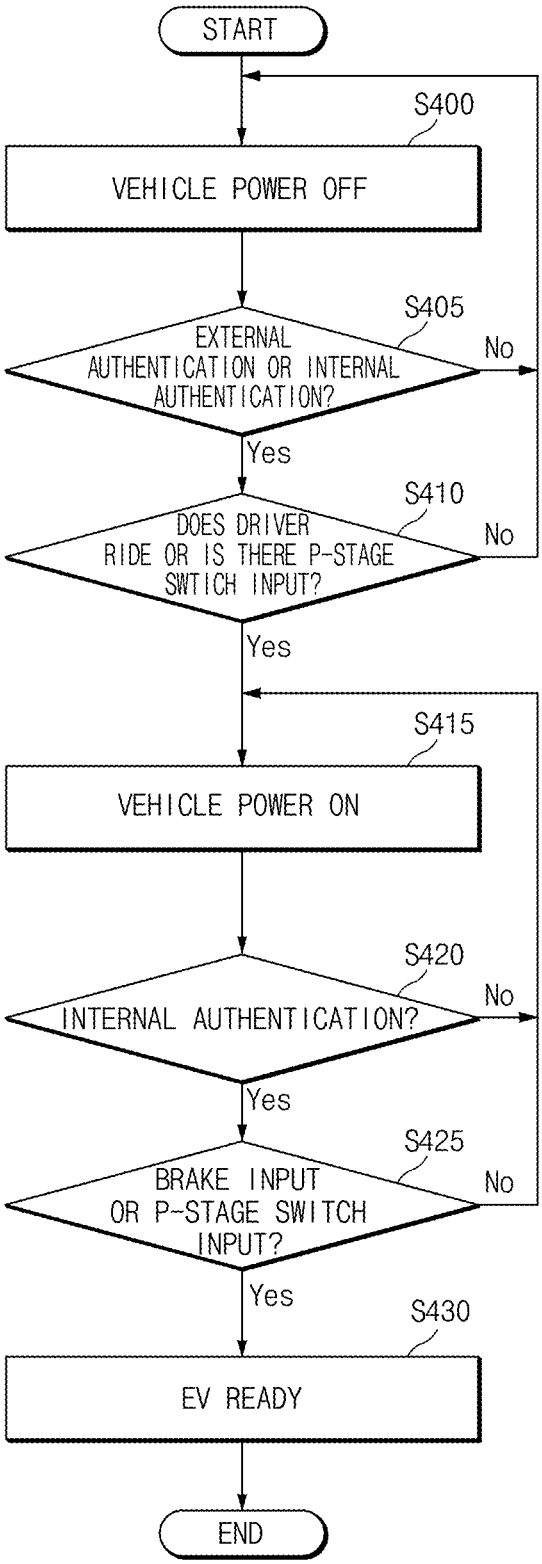
FIG. 5 is a flowchart illustrating a vehicle power control method according to another embodiment of the present disclosure.

FIG. 5 is a flowchart illustrating a vehicle power control method according to another embodiment of the present disclosure.

In S400, a body controller 190 of FIG. 1 may operate in a vehicle power off state.

In S405, the body controller 190 may determine whether to perform external authentication or internal authentication of an electronic key 200 of FIG. 1 The body controller 190 may perform external authentication through communication between the electronic key 200 and an NFC module 113 mounted on an outdoor handle. Furthermore, the body controller 190 may perform internal authentication through communication between the electronic key 200 and the NFC module 113 mounted on a WPC.

After performing the external authentication or the internal authentication of the electronic key 200, in S410, the body controller 190 may determine whether a driver rides in a vehicle or whether there is a P-stage switch input. After it is successful to perform the external authentication or the internal authentication of the electronic key 200 through NFC communication, the body controller 190 may determine whether a user sits in the driver's seat using a seat sensor 140 mounted on the driver's seat. The body controller 190 may determine whether the driver rides in the vehicle depending on whether the user sits in the driver's seat. Furthermore, the body controller 190 may determine whether there is a P-stage switch input using an SBW 150 of FIG. 1.

When the driver rides in the vehicle or when there is the P-stage switch input, in S415, the body controller 190 may transition to a vehicle power on state. When the user sits in the driver's seat or when a gear stage is set to a P stage, the body controller 190 may switch from the vehicle power off state to a vehicle power on state.

In S420, the body controller 190 may determine whether the internal authentication of the electronic key 200 is performed in the vehicle power on state. The body controller 190 may perform the internal authentication of the electronic key 200 using wireless communication with the NFC module 113 mounted on the WPC in the vehicle power on state.

After performing the internal authentication of the electronic key 200, in S425, the body controller 190 may determine whether there is a brake input or a P-stage switch input. The body controller 190 may determine whether there is a brake input using a brake switch 160 of FIG. 1 and may determine whether there is a P-stage switch input using the SBW 150.

When there is the brake input or the P-stage switch input, in S430, the body controller 190 may transition to an EV ready state. When there is the brake input or when the P-stage switch input is held above 10 seconds, the body controller 190 may control a power relay 180 to switch the vehicle power state from the vehicle power on state to the vehicle power off state.

Figure 6:
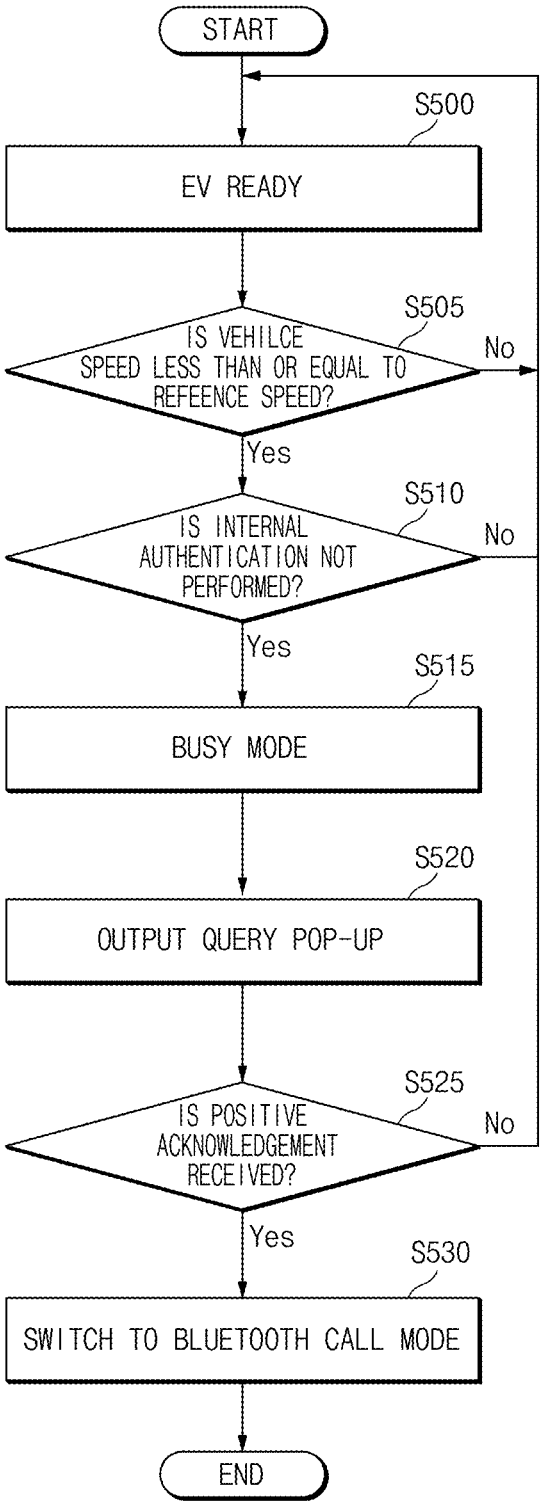
FIG. 6 is a flowchart illustrating a vehicle power control method according to another embodiment of the present disclosure.

FIG. 6 is a flowchart illustrating a vehicle power control method according to another embodiment of the present disclosure.

In S500, a body controller 190 of FIG. 1 may operate in an EV ready state.

In S505, the body controller 190 may determine whether the vehicle speed is less than or equal to a reference speed (e.g., 5 kph) in the EV ready state. The body controller 190 may verify a vehicle speed by means of a vehicle speed sensor, a navigation device 120 of FIG. 1, an autonomous controller 170 of FIG. 1, or the like.

When the vehicle speed is less than or equal to the reference speed, in S510, the body controller 190 may determine whether internal authentication of an electronic key 200 of FIG. is not performed. The body controller 190 may determine whether it is successful to perform internal authentication of the electronic key 200 through communication with an LF/RF module 112 of FIG. 1, an NFC module 113 mounted inside a vehicle, or the like.

When the internal authentication of the electronic key 200 is not performed, in S515, the body controller 190 may switch to a busy mode. When it fails to perform the internal authentication of the electronic key 200, the body controller 190 may determine that a user terminal equipped with the electronic key 200 is during a call to switch an operation mode to the busy mode.

In S520, the body controller 190 may output a query pop-up for verifying an intention to switch to a Bluetooth call mode. The body controller 190 may output a message proposing a change to a channel using Bluetooth on a cluster or a display of a navigation device 120 of FIG. 1.

In S525, the body controller 190 may determine whether a positive acknowledgement to the change to the Bluetooth call mode is received.

When the positive acknowledgement is received, the body controller 190 may switch to the Bluetooth call mode.

Figure 7:
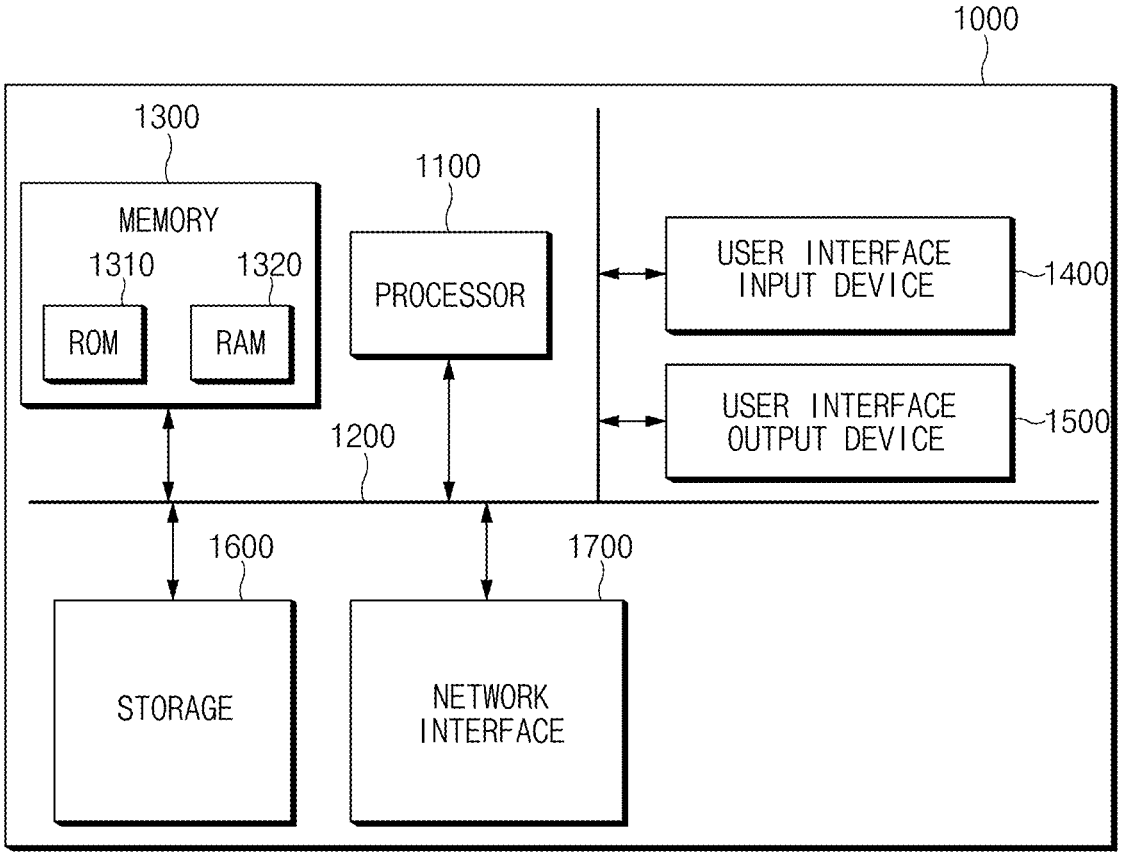
FIG. 7 is a block diagram illustrating a computing system for executing a vehicle power control method according to embodiments of the present disclosure.

FIG. 7 is a block diagram illustrating a computing system for executing a vehicle power control method according to embodiments of the present disclosure.

Referring to FIG. 7, a computing system 1000 may include at least one processor 1100, a memory 1300, a user interface input device 1400, a user interface output device 1500, storage 1600, and a network interface 1700, which are connected with each other via a bus 1200.

The processor 1100 may be a central processing unit (CPU) or a semiconductor device that processes instructions stored in the memory 1300 and/or the storage 1600. The memory 1300 and the storage 1600 may include various types of volatile or non-volatile storage media. For example, the memory 1300 may include a read only memory (ROM) 1310 and a random access memory (RAM) 1320.

Thus, the operations of the method or the algorithm described in connection with the embodiments disclosed herein may be embodied directly in hardware or a software module executed by the processor 1100, or in a combination thereof. The software module may reside on a storage medium (that is, the memory 1300 and/or the storage 1600) such as a RAM, a flash memory, a ROM, an EPROM, an EEPROM, a register, a hard disk, a removable disk, and a CD-ROM. The storage medium may be coupled to the processor, and the processor may read information out of the storage medium and may record information in the storage medium. Alternatively, the storage medium may be integrated with the processor 1100. The processor 1100 and the storage medium may reside in an application specific integrated circuit (ASIC). The ASIC may reside within a user terminal. In another case, the processor 1100 and the storage medium may reside in the user terminal as separate components.

According to embodiments of the present disclosure, the power control system may facilitate vehicle power transition in a situation where it is difficult to perform user authentication using an electronic key in the vehicle where the start manipulator is deleted.

Furthermore, according to embodiments of the present disclosure, the power control system may perform user authentication in a situation where a driver except for a vehicle owner operates a vehicle such as a sharing car or a robotaxi and may control power transition, thus increasing usability or convenience of the user.

Furthermore, according to embodiments of the present disclosure, the power control system may strengthen security by means of authentication of a driver except for a vehicle owner and power transition dualization control.

Furthermore, according to embodiments of the present disclosure, the power control system may facilitate power transition control in the factory mode (in the state where the electronic key is not learned) to supply a vehicle power in the process necessary to supply the vehicle power and may control power transition based on a separate electronic key internal authentication means, a P-stage switch input, and a brake switch input with regard to a factory work environment to provide a worker with working convenience.

Furthermore, according to embodiments of the present disclosure, the power control system may facilitate power transition control when the battery of the electronic key (e.g., a fob) is discharged and may guide the driver to perform an emergency start method upon emergency to facilitate vehicle driving, thus providing the user with usability and convenience.

Hereinabove, although the present disclosure has been described with reference to several embodiments and the accompanying drawings, the present disclosure is not limited thereto. The embodiments may be variously modified and altered by those having ordinary skill in the art to which the present disclosure pertains without departing from the spirit and scope of the present disclosure claimed in the following claims. Therefore, the embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims, and all the technical ideas within the scope equivalent to the claims should be included in the scope of the present disclosure.

What is claimed is:

1. A power control system for an electric vehicle in which a start manipulator is not included, the power control system comprising:

a communication device configured to perform wireless communication with an electronic key; and a body controller connected with the communication device, wherein the body controller is configured to determine a power control mode as a factory mode or an electronic key discharge mode based on whether the electronic key is learned and whether a battery of the electronic key is discharged and control vehicle power transition depending on power transition logic matched to the determined power control mode.

2. The power control system of claim 1, wherein the body controller determines the power control mode as the factory mode, when the electronic key is learned, and determines the power control mode as the electronic key discharge mode when the electronic key is not detected outside the vehicle and when a door is opened by a mechanical key, when the electronic key is learned.

3. The power control system of claim 1, wherein the body controller outputs an emergency start guide pop-up when the electronic key discharge mode is determined.

4. The power control system of claim 1, wherein the body controller verifies a vehicle door state using a door switch in the electronic key discharge mode to determine whether a driver rides in the vehicle.

5. The power control system of claim 1, wherein the body controller transitions a vehicle power state to a vehicle power on state when it is possible for the electronic key to perform immobilizer communication and when there is a P-stage switch input, and transitions the vehicle power state to an electric vehicle (EV) ready state when there is a brake input in the vehicle power on state.

6. The power control system of claim 5, wherein the body controller transitions the vehicle power state to a vehicle power off state when there is the P-stage switch input in the vehicle power on state, and transitions the vehicle power state to the vehicle power off state when there are the brake input and the P-stage switch input in the EV ready state.

7. The power control system of claim 1, wherein the body controller performs external authentication or internal authentication of the electronic key in a vehicle power off state and transitions a vehicle power state to a vehicle power on state when a driver rides in the vehicle or when a P-stage switch input is detected.

8. The power control system of claim 7, wherein the body controller performs the internal authentication of the electronic key in the vehicle power on state and transitions the vehicle power state to an EV ready state when a brake input or the P-stage switch input is detected.

9. The power control system of claim 1, wherein the body controller switches a power control mode to a shared mode, when a door is unlocked using a shared electronic key, transitions to a vehicle power on state, when at least one door is opened and all doors are closed in a vehicle power off state, and transitions to an EV ready state, when receiving a driving start request in the vehicle power on state, transitions to the vehicle power on state, when the vehicle arrives at a destination, at least one door is opened, and all the doors are closed, and transitions to the vehicle power off state, when a vehicle door is locked using the shared electronic key in the vehicle power on state.

10. The power control system of claim 9, wherein the body controller switches to a Bluetooth call mode when internal authentication of the electronic key is not performed when a vehicle speed is less than or equal to a reference speed in the EV ready state.

11. A power control method for an electric vehicle in which a start manipulator is not included, the power control method comprising:

determining, by a body controller, a power control mode as a factory mode or an electronic key discharge mode based on whether an electronic key is learned and whether a battery of the electronic key is discharged, wherein the body controller performs wireless communication with the electronic key using a communication device; and controlling, by the body controller, vehicle power transition depending on power transition logic matched to the determined power control mode.

12. The power control method of claim 11, wherein the determining of the power control mode as the factory mode or the electronic key discharge mode includes:

determining the power control mode as the factory mode when the electronic key is learned; and determining the power control mode as the electronic key discharge mode when the electronic key is not detected outside the vehicle and when a door is opened by a mechanical key, when the electronic key is learned.

13. The power control method of claim 12, wherein the determining of the power control mode as the factory mode or the electronic key discharge mode further includes:

outputting an emergency start guide pop-up when the electronic key discharge mode is determined.

14. The power control method of claim 11, wherein the controlling of the vehicle power transition includes:

verifying a vehicle door state using a door switch in the electronic key discharge mode to determine whether a driver rides in the vehicle.

15. The power control method of claim 11, wherein the controlling of the vehicle power transition includes:

transitioning a vehicle power state to a vehicle power on state when it is possible for the electronic key to perform immobilizer communication and when there is a P-stage switch input; and transitioning the vehicle power state to an EV ready state when there is a brake input in the vehicle power on state.

16. The power control method of claim 15, wherein the controlling of the vehicle power transition further includes:

transitioning the vehicle power state to a vehicle power off state when there is the P-stage switch input in the vehicle power on state; and transitioning the vehicle power state to the vehicle power off state when there are the brake input and the P-stage switch input in the EV ready state.

17. The power control method of claim 11, further comprising:

performing external authentication or internal authentication of the electronic key in a vehicle power off state and transitioning a vehicle power state to a vehicle power on state when a driver rides in the vehicle or when a P-stage switch input is detected.

18. The power control method of claim 17, further comprising:

performing the internal authentication of the electronic key in the vehicle power on state and transitioning the vehicle power state to an EV ready state when a brake input or the P-stage switch input is detected.

19. The power control method of claim 11, further comprising:

switching a power control mode to a shared mode when a door is unlocked using a shared electronic key;

transitioning to a vehicle power on state when at least one door is opened and all doors are closed in a vehicle power off state;

transitioning to an EV ready state when receiving a driving start request in the vehicle power on state;

transitioning to the vehicle power on state when the vehicle arrives at a destination, at least one door is opened, and all the doors are closed; and transitioning to a vehicle power off state when a vehicle door is locked using the shared electronic key in the vehicle power on state.

20. The power control method of claim 19, further comprising:

switching to a Bluetooth call mode when internal authentication of the electronic key is not performed when a vehicle speed is less than or equal to a reference speed in the EV ready state.

* * * * *